US005661996A

United States Patent [19]

Welty

[11] Patent Number: 5,661,996

[45] Date of Patent: Sep. 2, 1997

[54] BACK GAGE FOR A BENDING BRAKE

[76] Inventor: Robert E. Welty, 361 River Pl., Gadadon, Ala. 35901

[21] Appl. No.: 602,956

[22] Filed: Feb. 16, 1996

[51] Int. Cl.[6] ..... B21D 11/22

[52] U.S. Cl. ..... 72/461; 72/31.01; 72/319; 72/420

[58] Field of Search ..... 72/461, 420, 319, 72/37, 31.01

[56] References Cited

U.S. PATENT DOCUMENTS

| | | | |
|---|---|---|---|
| 362,749 | 5/1887 | Keene . | |
| 816,917 | 4/1906 | Keene . | |
| 941,783 | 11/1909 | Keene . | |
| 1,721,698 | 7/1929 | Krueger . | |
| 2,557,346 | 6/1951 | Green . | |
| 2,699,812 | 1/1955 | McCormack et al. . | |
| 2,767,762 | 10/1956 | Peterson . | |
| 3,192,759 | 7/1965 | Pelton et al. . | |
| 3,359,772 | 12/1967 | Fillip . | |
| 3,568,300 | 3/1971 | Zidell . | |
| 3,826,119 | 7/1974 | Marotto | 72/461 |
| 3,913,370 | 10/1975 | Break . | |
| 3,914,974 | 10/1975 | DeVore . | |
| 3,948,074 | 4/1976 | Stalzer . | |
| 4,351,176 | 9/1982 | Anderson . | |
| 4,510,785 | 4/1985 | Triouleyre et al. . | |
| 4,713,957 | 12/1987 | Eder et al. . | |
| 5,211,045 | 5/1993 | Shimizu | 72/461 |
| 5,386,643 | 2/1995 | Corcoran . | |
| 5,426,863 | 6/1995 | Biggel . | |

FOREIGN PATENT DOCUMENTS

| | | | |
|---|---|---|---|
| 275532 | 11/1987 | Japan | 72/461 |
| 11035 | 1/1989 | Japan | 72/461 |
| 157718 | 6/1989 | Japan | 72/461 |
| 174920 | 7/1989 | Japan | 72/461 |
| 221226 | 9/1991 | Japan | 72/461 |

*Primary Examiner*—David Jones
*Attorney, Agent, or Firm*—Leydig, Voit & Mayer, Ltd.

[57] ABSTRACT

A back gage is provided for use with a bending brake of a type that comprises a generally flat bed and a brake edge. In use, the bending brake receives the leading edge of a sheet metal member and bends a portion of the member around the brake edge in order to form a shape therein. The back gage of the present invention broadly comprises a movable carriage assembly arranged on the bed of the bending brake, a drive assembly for moving the carriage assembly relative to the brake edge of the bending brake, and a measuring device mounted to the bed of the bending brake and coupled to the movable carriage assembly. In practice, when the leading edge of the sheet metal member engages the movable carriage assembly, the measuring device conveniently displays the distance between the leading edge of the member and the brake edge of the bending brake.

25 Claims, 6 Drawing Sheets

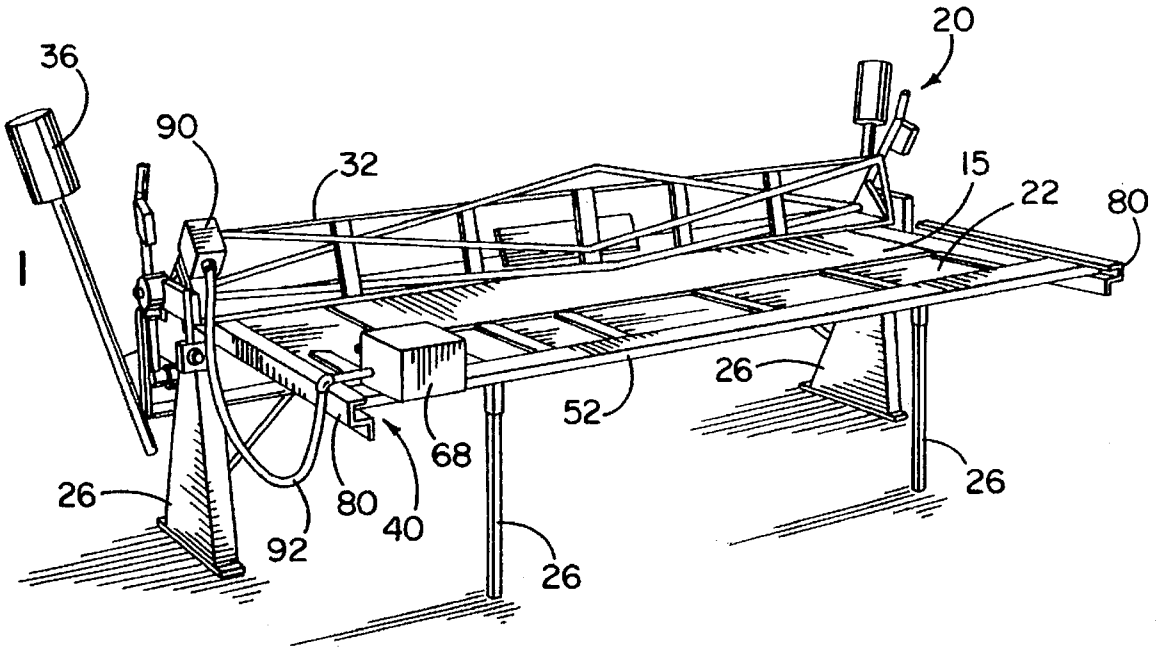
FIG. 1
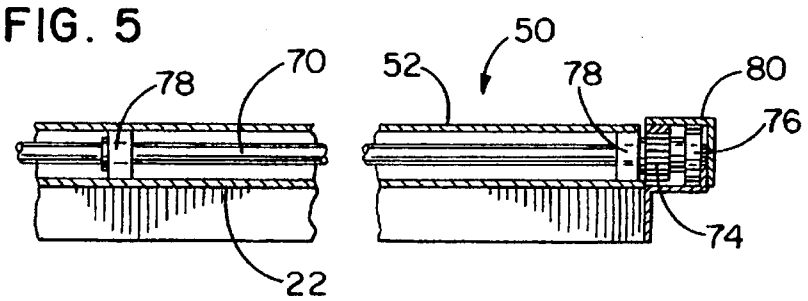
FIG. 5
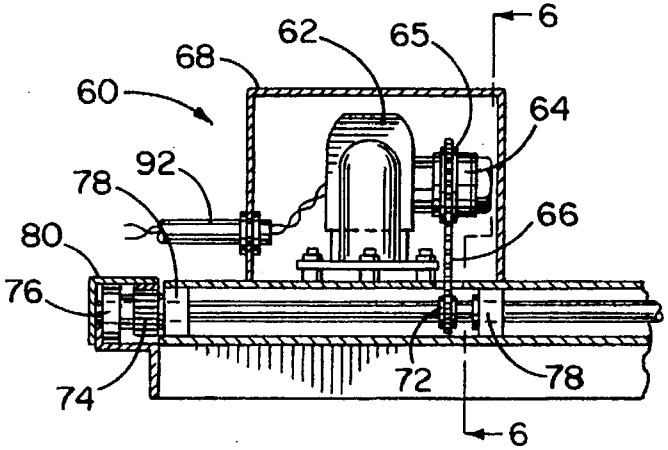

BACK GAGE FOR A BENDING BRAKE

TECHNICAL FIELD OF THE INVENTION

The present invention relates generally to bending brakes and, more particularly, to a back gage for a bending brake that automatically measures the distance between the brake edge of the bending brake and the leading edge of a sheet metal member when the member is installed in the bending brake.

BACKGROUND OF THE INVENTION

Bending brakes are machines that are adapted to form sheet metal members into a variety of shapes by one or more bending or folding operations. In use, a sheet metal member is installed in a bending brake and the member is folded around a brake edge of the bending brake in order to form a shape therein. However, in order to fold the sheet metal member at a desired location, the member is typically measured and marked before being installed in the bending brake. In this way, the member may be folded at the desired location by situating the mark on the member at the brake edge of the bending brake. The pre-measuring and marking of sheet metal members, however, is a rather time consuming and labor intensive process, especially when several members must be bent and/or more than one fold in a single member must be made.

SUMMARY OF THE INVENTION

Accordingly, a primary object of the present invention is to provide a back gage for a bending brake that automatically measures a sheet metal member as it is being installed in a bending brake.

A more specific object of the present invention is to provide a back gage for a bending brake that automatically measures the distance between the leading edge of a sheet metal member and the brake edge of the bending brake when the sheet metal member is installed in the bending brake.

Another object of the present invention is to provide a back gage for a bending brake that is simple to operate.

A further object of the present invention is to provide a back gage for a bending brake that requires little or no maintenance.

An additional object of the present invention is to provide a back gage for a bending brake that is simple in construction.

A related object of the present invention is to provide a back gage for a bending brake that may be readily assembled to the bending brake.

Still another object of the present invention is to provide a back gage for a bending brake that is both strong and durable.

Yet another object of the present invention is to provide a back gage for a bending brake which is simple and inexpensive to fabricate and reliable and convenient to use.

In accordance with these and other objects, a back gage for use with a standard bending brake is provided. More specifically, the back gage of the present invention is used with a bending brake of a type that comprises a generally flat bed and a brake edge. In use, a bending brake of this type receives the leading edge of a sheet metal member and bends a portion of the member around the brake edge in order to form a shape therein. When the sheet metal member is installed in a bending brake of this type, the back gage of the present invention automatically measures the distance between the leading edge of the member and the brake edge of the bending brake. In particular, the back gage of the present invention broadly comprises a movable carriage assembly arranged on the bed of the bending brake, a drive assembly for moving the carriage assembly relative to the brake edge of the bending brake, and a measuring device mounted to the bed of the bending brake and coupled to the movable carriage assembly. In practice, when the leading edge of the sheet metal member engages a portion of the movable carriage assembly, the measuring device conveniently displays the distance between the leading edge of the member and the brake edge of the bending brake.

BRIEF DESCRIPTION OF THE DRAWINGS

FIG. 1 is a perspective view of a bending brake and an attached back gage constructed in accordance with the teachings of the present invention;

FIG. 5 is an enlarged cross-sectional view, taken along line 5—5 in FIG. 3, showing the drive and movable carriage assemblies of the back gage;

Figure 2:
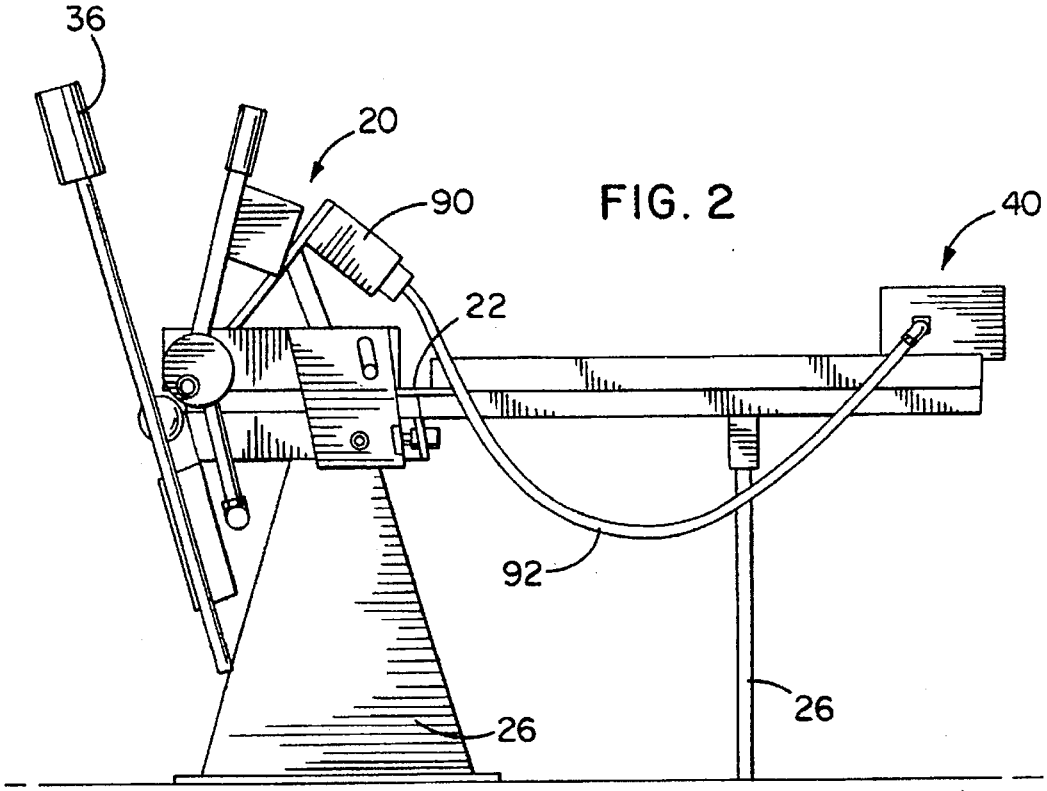
FIG. 2 is a side elevational view of the bending brake and attached back gage.

While the present invention will be described and disclosed in connection with a preferred embodiment, the intent is not to limit the present invention to this specific embodiment. On the contrary, the intent is to cover all such alternatives, modifications, and equivalents that fall within the spirit and scope of the present invention as defined by the appended claims.

DETAILED DESCRIPTION OF THE PREFERRED EMBODIMENT

Referring now to the drawings, there is illustrated a standard bending brake 20 and an attached back gage 40 constructed in accordance with the teachings of the present invention. In use, the bending brake 20 receives and bends a sheet metal member (or workpiece) 15 having a leading edge 16. The back gage 40 of the present invention measures and displays how far the leading edge 16 of the sheet metal member 15 has been inserted into the bending brake 20.

Figure 3:
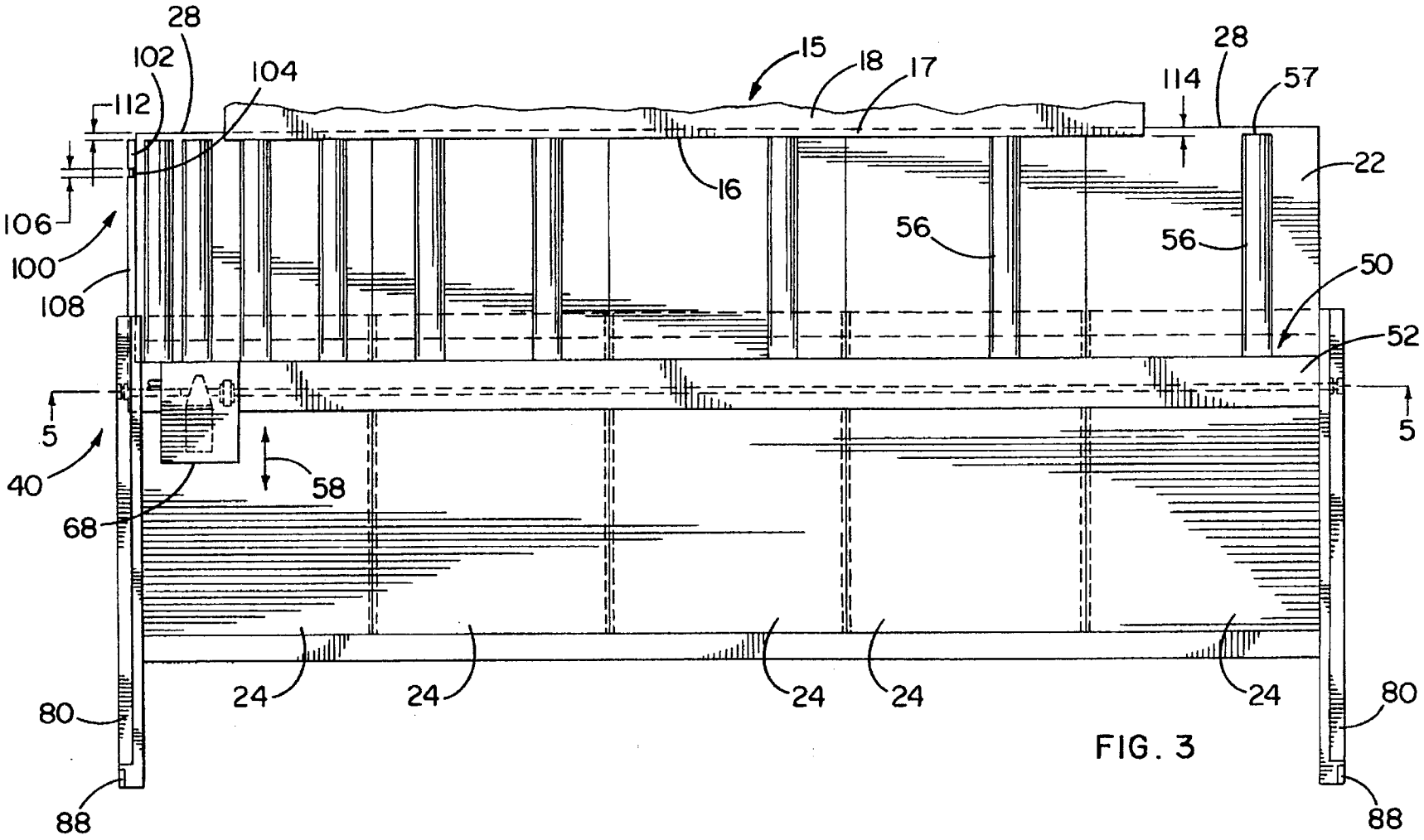
FIG. 3 is a top plan view of the bending brake and attached back gage, showing the movable carriage assembly of the back gage in a generally forward position.
Figure 4:
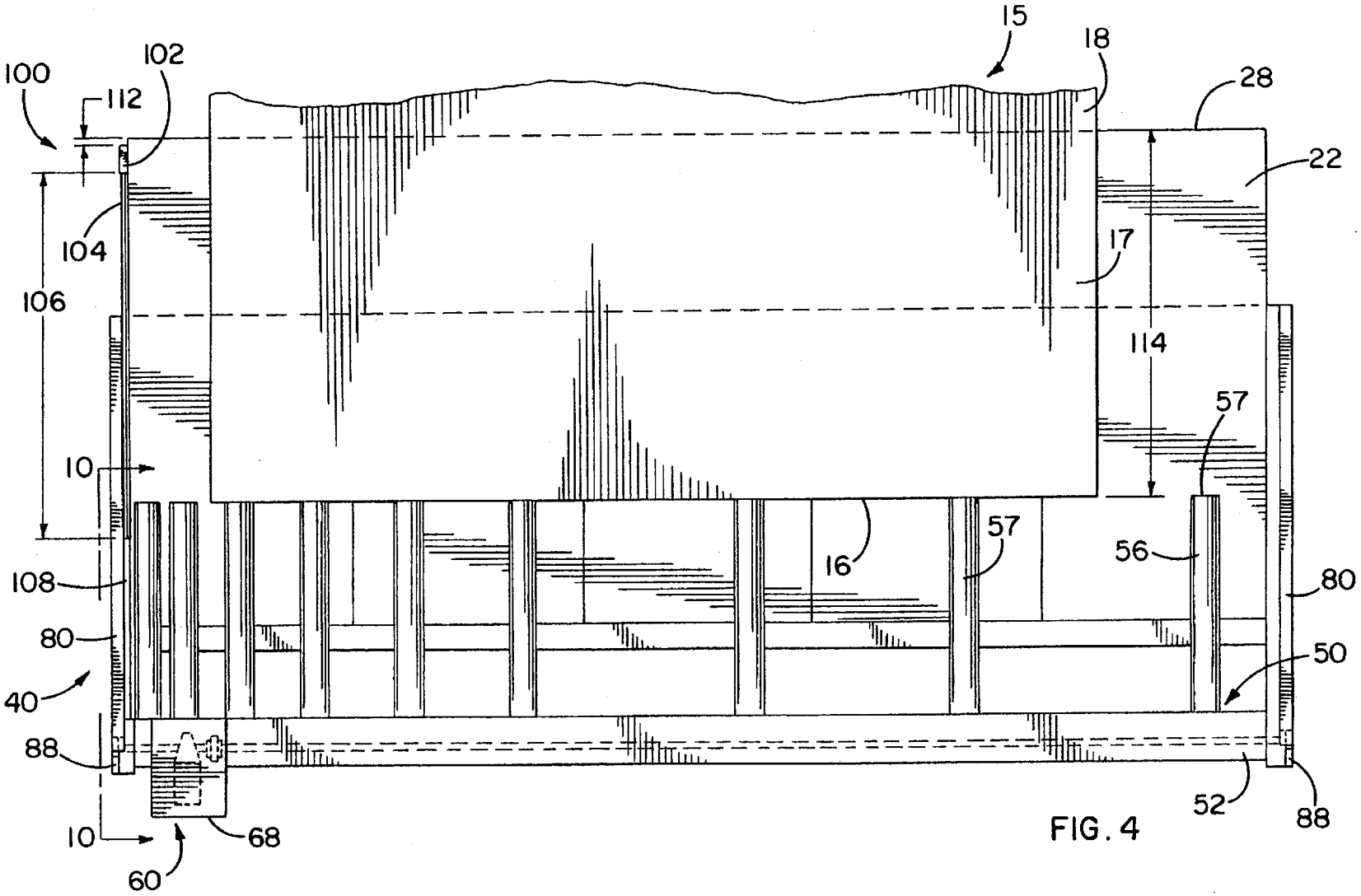
FIG. 4 is a top plan view of the bending brake and attached back gage, showing the movable carriage assembly of the back gage in a generally rearward position.
Figure 8:
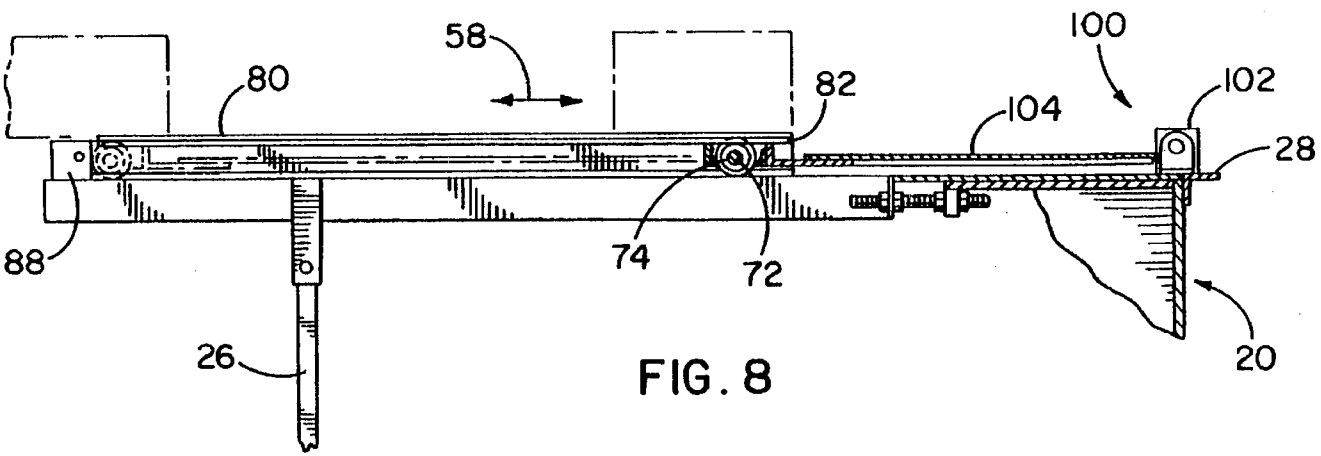
FIG. 8 is a partial cross-sectional view, taken along line 8—8 in FIG. 7, depicting the operation of the measuring device of the back gage as the drive shaft moves along one of the opposed side channels.

As shown in FIGS. 1 and 2, the bending brake 20 includes a generally flat and rectangular bed (or support table) 22 which is separated from the floor (or ground) by a plurality of leg members 26. In the illustrated embodiment, the bed 22 is made up of several removable panels 24 that are Joined together to form a top working surface (see FIG. 3). As shown in FIGS. 3, 4, and 8, the bending brake 20 also includes a brake edge (or shaping edge) 28 arranged along one of the sides of the bed 22.

As best depicted in FIGS. 3 and 4, the sheet metal member 15 is partially inserted into the bending brake 20. In particular, a first portion 17 of the sheet metal member 15 engages the bed 22 while a second portion 18 of the member 15 extends off of the bed 22 (i.e., beyond the brake edge 28). In operation, the bending brake 20 forms a bend (or shaped contour) in the sheet metal member 15 by folding the second portion 18 of the member 15 around the brake edge 28 while the first portion 17 is retained in engagement with the top surface 24 of the bed 22. As such, the bending brake 20 also includes a pivotable bending element 32 that is operated by lever 36. When lever 36 is pulled, the bending element 32 pivots with respect to the brake edge 28 and causes the second portion 18 of the sheet metal member 15 to be bent around the brake edge 28.

The back gage 40 of the present invention broadly comprises: (1) a movable carriage assembly 50 arranged on the bed 22 of the bending brake 20 and arranged generally parallel to the brake edge 28; (2) a drive assembly 60 for moving the carriage assembly 50 with respect to the brake edge 28 of the bending brake 20; and (3) a measuring device 100. In accordance with certain objects of the present invention, the measuring device 100 automatically displays the distance between the leading edge 16 of the sheet metal member 15 and the brake edge 28 of the bending brake 20 when the member 15 is installed in the bending brake 20. The back gage 40 of the present invention provides substantial benefits over the prior art. One important benefit is that the sheet metal member 15 does not have to be measured before being inserted into the bending brake 20. Instead, the measuring device 100 of the present invention automatically displays the distance between the leading edge 16 of the sheet metal member 15 and the brake edge 28 of the bending brake 20. In this way, a bend (or fold) may be made at a desired location in the sheet metal member 15 without pre-measuring it.

Figure 6:
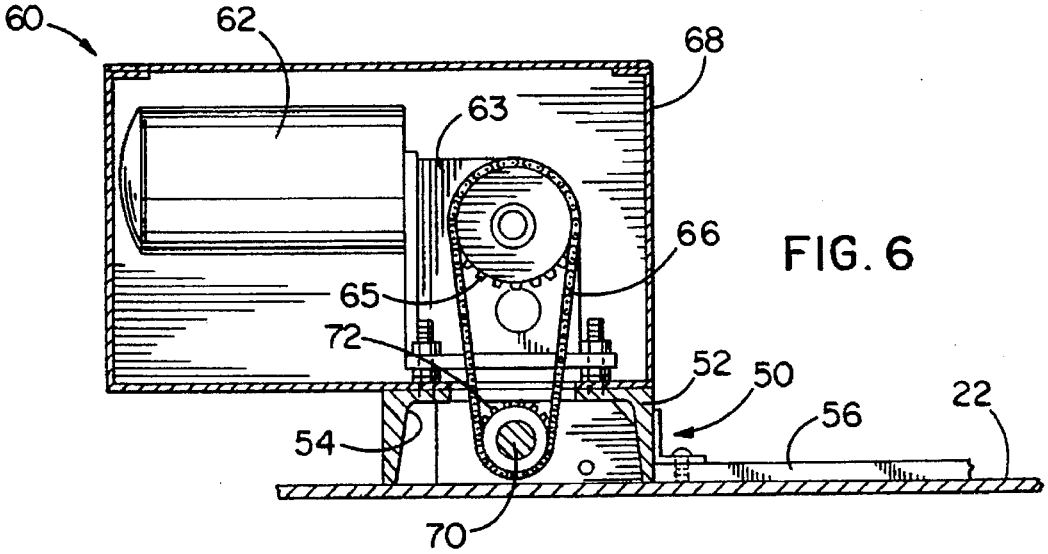
FIG. 6 is an enlarged partial cross-sectional view, taken along line 6—6 in FIG. 5, showing the drive and movable carriage assemblies of the back gage.

In the illustrated embodiment, the carriage assembly 50 of the present invention comprises a beam (or frame member) 52 having a channel 54 formed therein. Preferably, the beam 52 of the carriage assembly 50 extends substantially across the bed 22 of the bending brake 20, as shown in FIGS. 3 and 4. In addition, a plurality of spaced apart fingers 56 are attached to the exterior of the beam 52. As shown in FIGS. 3, 4, and 6, the fingers 56 project toward the brake edge 28 and engage the bed 22. Preferably, the fingers 56 are of equal length and are unevenly spaced. In use, the carriage assembly 50 provides a movable stop for the leading edge 16 of the sheet metal member 15 when the member 15 is inserted into the bending brake 20. More specifically, the fingers 56 of the movable carriage assembly 50 provide the movable stop. As shown in FIGS. 3 and 4, the leading edge 16 of the sheet metal member 15 will normally engage the end 57 of the fingers 56 when the member 15 is inserted into the bending brake 20.

The drive assembly 60 of the present invention selectively moves the carriage assembly 50 relative to the brake edge 28 of the bending brake 20. In particular, drive assembly 60 tows the carriage assembly 50 in two alternate directions (i.e., either toward brake edge 28 or away from brake edge 28), as generally indicated by the arrows of reference numeral 58. By way of example, FIG. 3 of the drawings depicts the carriage assembly 50 in a generally forward position, while FIG. 4 depicts the carriage assembly 50 in a generally rearward position.

In the illustrated embodiment, the drive assembly 60 includes a drive shaft 70 and a motor 62 for rotating the drive shaft 70. As shown in FIGS. 5 and 6, the motor 62 of the drive assembly 60 includes an attached gear box 63, a slip clutch assembly 64, and a drive chain 66 which couples the slip clutch assembly 64 to the drive shaft 70. The drive chain 66 links a first sprocket 65 arranged on the slip clutch assembly 64 with a second sprocket 72 arranged on the drive shaft 70. In operation, the motor 62 drives the gear box 63 which, in turn, rotates the slip clutch assembly 64. As the slip clutch assembly 64 rotates, the drive chain 66 transfers torque from the motor 62 to the drive shaft 70 which causes the drive shaft 70 to rotate. As best shown in FIG. 6, the motor 62 is mounted to the top of the beam 52 of the carriage assembly 50. In addition, all of the components of the drive assembly 60 (i.e., the motor 62, the gear box 63, the slip clutch assembly 64, and the drive chain 66) are enclosed within a protective housing 68.

In keeping with an important aspect of the present invention, the motor 62 of the drive assembly 60 is reversible. In this way, the drive shaft 70 and attached carriage assembly 50 may be moved in either of the two alternate directions indicated by the arrows of reference numeral 58. In keeping with another important aspect of the present invention, the speed of the motor 62 is adjustable. More specifically, the motor 62 should have at least two operating speeds (e.g., fast, slow, etc.). In this way, the drive shaft 70 and attached carriage assembly 50 may be driven relative to the brake edge 28 of the bending brake 20 at varying rates of speed. In the illustrated embodiment, the speed and direction of the motor 62 are regulated by a control box assembly 90. As best shown in FIGS. 1 and 2, the control box assembly 90 is attached to the bending brake 20 and is connected to the motor 62 via line 92. Of course, the control box assembly 90 includes both a two-Way direction controller (not shown) and a speed controller (not shown).

Figure 7:
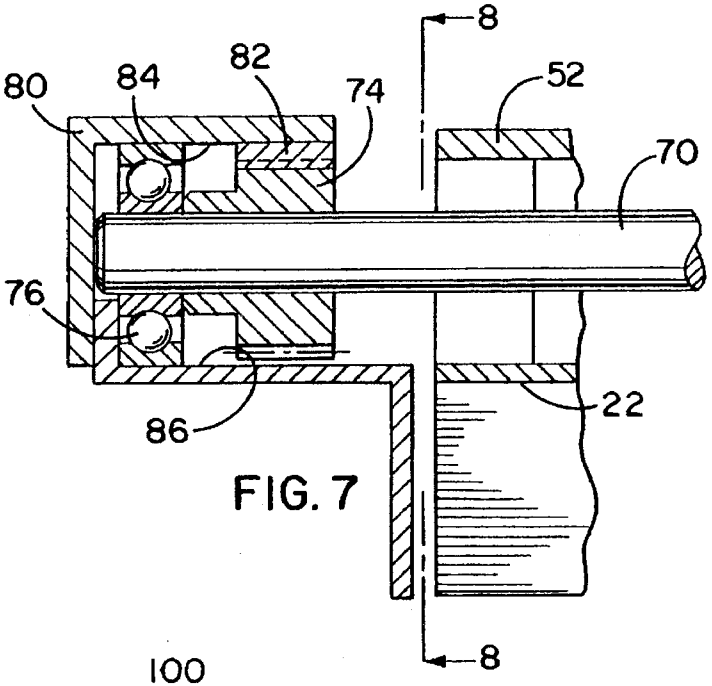
FIG. 7 is an enlarged partial cross-sectional view, taken along line 5—5 in FIG. 3, showing the drive shaft of the drive assembly being received by one of the opposed side channels.

The drive shaft 70, like the beam 52 of the carriage assembly 50, extends across the bed 22 of the bending brake 20. The drive shaft 70 also resides within and along the channel 54 of the beam 52. Put another way, the beam 52 of the carriage assembly 50 houses the drive shaft 70. As shown in FIGS. 5 and 7, the ends of the drive shaft 70 extend beyond the length of the beam 52 and are received by a pair of opposed side channels 80. The opposed side channels 80 are affixed to the bed 22 of the bending brake 20 and are arranged generally perpendicular to the drive shaft 70. In the illustrated embodiment, the opposed side channels 80 are formed of separate construction. It will be understood by those skilled in the art, however, that the opposed side channels 80 may alternatively be formed of unitary construction.

Figure 9:
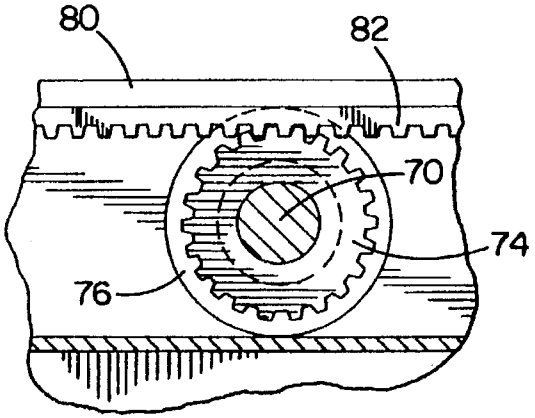
FIG. 9 is an enlarged partial cross-sectional view, taken along line 8—8 in FIG. 7, showing one of the pinion gears of the drive shaft engaging an associated rack installed within one of the opposed side channels.

The drive shaft 70 and attached carriage assembly 50 are guided in movement with respect to the brake edge 28 of the bending brake 20 by a rack and pinion assembly. In the illustrated embodiment, the rack and pinion assembly comprises a pair of pinion gears 74 which coact with a pair of associated racks 82. As best shown in FIGS. 7 and 9, the pinion gears 74 the arranged on opposite ends of the drive shaft 70 and the racks 82 are fixedly installed within the opposed side channels 80. In the illustrated embodiment, the racks 82 are arranged on the upper inside surface 84 of the channels 80. It will be understood by those skilled in the art, however, that the racks 82 may alternatively by arranged on the lower inside surface 86 of the channels 80.

In application, when the drive shaft 70 is rotated by the motor 62, the interaction between the pinion gears 74 and the stationary racks 82 converts the rotational motion of the drive shaft 70 into rectilinear motion. Of course, depending on the direction of the motor 62, the drive shaft 70 and attached carriage assembly 50 may be moved in either of the two alternate directions indicated by the arrows of reference numeral 58 (i.e., either toward brake edge 28 or away from brake edge 28).

A pair of roller bearings 76 are provided to help retain the pinion gears 74 of the drive shaft 70 in engagement with the racks 82. The roller bearings 76 also facilitate smooth rectilinear motion of the drive shaft 70 along the opposed side channels 80. As shown in FIGS. 5 and 7, the roller bearings 76 are arranged on opposite ends of the drive shaft 70 and abut the pinion gears 74. A plurality of spaced apart bearing support blocks 78 are also arranged on the drive shaft 70. In use, the bearing support blocks 78 help retain the drive shaft 70 in proper alignment within the channel 54 of the beam 52 (i.e., spaced apart from bed 22 of the bending brake 20).

In order to prevent the drive shaft 70 and attached carriage assembly 50 from moving beyond the rearward position depicted in FIG. 4, a stop block 88 is arranged in each of the opposed side channels 80. In use, the stop blocks 88 are engaged by the pinion gears 74 of the drive shaft 70, as shown, for example, in FIG. 8.

In keeping with another important aspect of the present invention, the measuring device 100 of the back gage 40 is mounted to the bed 22 of the bending brake 20 and is also coupled to the movable carriage assembly 50. In the illustrated embodiment, the measuring device 100 comprises a standard retractable tape measure 102. In operation, when the carriage assembly 50 is moved relative to the brake edge 28 of the bending brake 20, the tape measure 102 remains affixed to the bed 22 of the bending brake 20, but the tape portion 104 of the tape measure 102 is towed by the carriage assembly 50. In this way, the tape measure 102 advantageously displays the distance between the tape measure 102 and the movable carriage assembly 50. It will be appreciated by those skilled in the art that the retractable tape measure 102 may further comprise a digital readout. A digital readout tape measure combines the features of a conventional retractable tape measure 102 with an electronic display. Such tape measure products are also available with conversion capabilities which allows the digital readout to be automatically converted, for example, from english units (inches, feet, etc.) to metric units (millimeters, centimeters, etc.), or vice versa. Furthermore, in an alternative embodiment of the present invention, a digital-encoder readout device may be substituted for the measuring device 100 described herein.

As shown in FIGS. 3, 4, and 8, the tape measure 102 is affixed to the bed 22 of the bending brake 20 in close proximity to the brake edge 28. In addition, the tape portion 104 of the tape measure 102 is connected to the movable carriage assembly 50 via a pull rod 108. As best illustrated in FIG. 3, the combined length of the pull rod 108, the tape measure 102, and the distance indicated by reference numeral 112 (i.e., the distance between the brake edge 28 of the bending brake 20 and the tape measure 102) is equal to the length of the fingers 56. In this way, the readout of the tape measure 102 (i.e., the distance indicated by reference numeral 106) always equals the distance between the end 57 of the fingers 56 and the brake edge 28 of the bending brake 20 (i.e., the distance indicated by reference numeral 114). Of course, as an added feature, the tape measure 102 may also include a digital readout with conversion capabilities.

In operation, the amount of tape 104 extracted from the tape measure 102 automatically changes as the carriage assembly 50 is moved relative to the brake edge 28 of the bending brake 20. In addition, the readout of the tape measure 102 (i.e., the distance indicated by reference numeral 106) always equals the distance between the end 57 of the fingers 56 and the brake edge 28 of the bending brake 20 (i.e., the distance indicated by reference numeral 114). Thus, when the leading edge 16 of the sheet metal member 15 is in engagement with the fingers 56 of the carriage assembly 50, as shown, for example, in FIGS. 3 and 4, the readout of the tape measure 102 (i.e., the distance indicated by reference numeral 106) automatically equals the distance between the leading edge 16 of the sheet metal member 15 and the brake edge 28 of the bending brake 20 (i.e., the distance indicated by reference numeral 114). In this way, the back gage 40 of the present invention automatically displays the distance between the leading edge 16 of the sheet metal member 15 and the brake edge 28 of the bending brake 20 when the leading edge 16 of the member 15 is in engagement with the movable stop provided by the fingers 56 of the carriage assembly 50. Thus, in contradistinction to the prior art, the sheet metal member 15 does not have to be measured before it is inserted into the bending brake 20.

Figure 10:
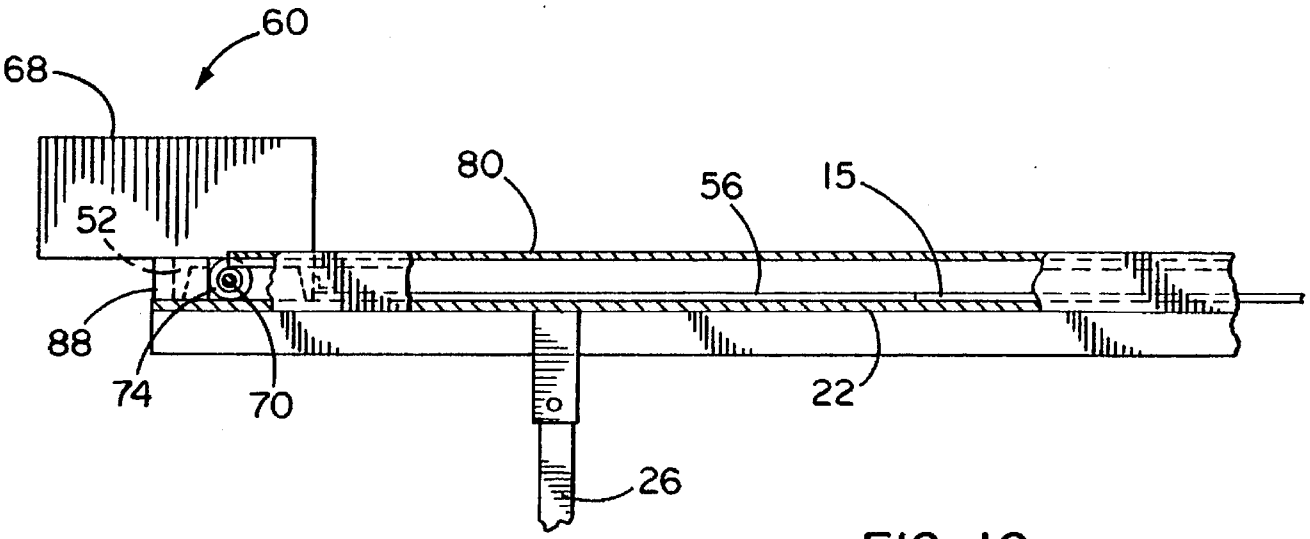
FIG. 10 is an enlarged, partially cut away, side elevational view of the bending brake and attached back gage, showing a sheet metal member engaging the fingers of the movable carriage assembly.
Figure 11:
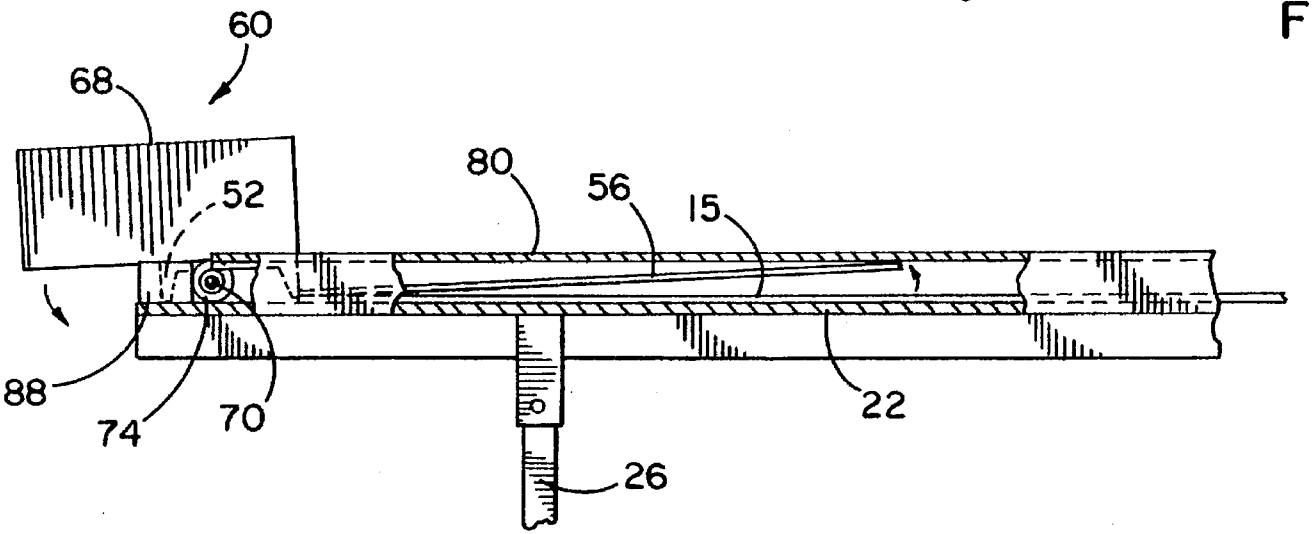
FIG. 11 is an enlarged, partially cut away, side elevational view of the bending brake and attached back gage, showing the movable carriage assembly and the fingers of the movable carriage assembly pivoted with respect to the bed of the bending brake and showing the sheet metal member engaging the beam of the movable carriage assembly.

As discussed above, the fingers 56 of the carriage assembly 50 normally comprise the movable stop for the leading edge 16 of the sheet metal member 16. For example, when the movable carriage assembly 50 is in the position depicted in FIG. 3, no further insertion of the sheet metal member 15 is possible unless the carriage assembly 50 is moved rearwardly (i.e., away from the brake edge 28). Furthermore, once the carriage assembly 50 is in its rearwardmost position, as shown, for example, in FIGS. 4 and 10, no further insertion of the sheet metal member 15 is possible. As an added feature of the present invention, however, some additional insertion is possible when the carriage assembly 50 is in its rearwardmost position. As shown in FIG. 11, the carriage assembly 50 may be pivoted slightly with respect to the bed 22 of the bending brake 20 when the pinion gears 74 of the drive shaft 70 are in engagement with the stop blocks 88 of the opposed side channels 80 and the motor 62 continues to apply torque to the drive shaft 70. When this occurs, the fingers 56 of the carriage assembly 50 elevate off of the bed 22 of the bending brake 20 and the sheet metal member 15 may be slid underneath the fingers 56. In other words, the sheet metal member 15 may be inserted further into the bending brake 20. Of course, when the fingers 56 are elevated off of the bed 22 of the bending brake, the beam 52 of the carriage assembly 50 becomes the stop for the leading edge 15 of the sheet metal member 15.

What is claimed is:

1. A back gage for use with a bending brake of a type that comprises a generally flat bed and a brake edge, the bed of the bending brake providing a support surface for a sheet metal member as a portion of said member is bent around the brake edge in order to form a shape therein, the sheet metal member having a leading edge, the bending brake receiving the leading edge of the sheet metal member, the back gage automatically measuring the distance between the leading edge of the sheet metal member and the brake edge of the bending brake when said member is installed in the bending brake, the back gage comprising, in combination:

a movable carriage assembly arranged to be mounted generally parallel to the brake edge of the bending brake;

a drive assembly for selectively moving said carriage assembly relative to the brake edge of the bending brake; and a mechanical measuring device adapted to be mounted to the bending brake and coupled to the movable carriage assembly, the mechanical measuring device displaying the distance between the leading edge of the sheet metal member and the brake edge of the bending brake when the leading edge of said member engages the movable carriage assembly.

2. The back gage as set forth in claim 1, wherein the mechanical measuring device comprises a tape measure.

3. The back gage as set forth in claim 2, wherein the tape measure includes a digital readout.

4. The back gage as set forth in claim 1, wherein the drive assembly comprises a drive shaft arranged generally parallel to the brake edge of the bending brake and a motor for rotating the drive shaft.

5. The back gage as set forth in claim 4, wherein the drive shaft is coupled to the motor by a drive chain, the drive chain transferring torque from the motor to the drive shaft.

6. The back gage as set forth in claim 4, wherein the motor is reversible and the drive shaft is rotatable in two directions.

7. The back gage as set forth in claim 4, wherein the motor has at least one operating speed.

8. The back gage as set forth in claim 4, wherein the movable carriage assembly is towed by the drive shaft of the drive assembly, the movable carriage assembly comprising a beam having a channel formed therein, the beam engaging the bed of the bending brake, the channel of the beam housing the rotatable drive shaft of the drive assembly.

9. The back gage as set forth in claim 8, wherein the beam of the movable carriage assembly extends substantially across the bed of the bending brake.

10. The back gage as set forth in claim 8, wherein the motor is mounted to the beam of the movable carriage assembly.

11. The back gage as set forth in claim 10, wherein a pair of pinion gears are arranged on opposite ends of the drive shaft.

12. The back gage as set forth in claim 11, wherein each pinion gear coacts with an associated rack.

13. The back gage as set forth in claim 12, wherein the racks are fixedly disposed with respect to the bed of the bending brake such that the drive shaft and the movable carriage assembly are driven relative to the brake edge of the bending brake when the drive shaft is rotated by the motor.

14. The back gage as set forth in claim 13, wherein each rack is installed within an opposed side channel, each opposed side channel affixed to the bed of the bending brake and arranged generally perpendicular to the drive shaft.

15. The back gage as set forth in claim 14, wherein a pair of roller bearings are arranged on opposite ends of the drive shaft and are disposed within the opposed side channels, the roller bearings retaining the pinion gears in engagement with the racks.

16. The back gage as set forth in claim 14, wherein each opposed side channel includes an associated stop block, the stop blocks preventing further movement of the movable carriage assembly in a direction away from the brake edge of the bending brake when the pinion gears of the drive shaft engage the stop blocks.

17. The back gage as set forth in claim 8, wherein a plurality of spaced apart bearing support blocks are arranged on the drive shaft, the bearing support blocks retaining the drive shaft in position with respect to the channel of the beam and the bed of the bending brake.

18. The back gage as set forth in claim 8, wherein a plurality of spaced apart fingers are attached to the beam of the movable carriage assembly, the fingers engaging the bed of the bending brake and projecting toward the brake edge of the bending brake.

19. The back gage as set forth in claim 18, wherein the fingers provide a movable stop for the leading edge of the sheet metal member when said member is inserted into the bending brake.

20. The back gage as set forth in claim 19, wherein the fingers are of equal length.

21. The back gage as set forth in claim 20, wherein the fingers are unevenly spaced apart.

22. The back gage as set forth in claim 18, wherein the beam of the movable carriage assembly pivots with respect to the bed of the bending brake when the pinion gears of the drive shaft engage the stop blocks of the opposed side channels and the motor continues to apply torque to the drive shaft.

23. The back gage as set forth in claim 22, wherein the fingers elevate off of the bed of the bending brake when the beam of the movable carriage assembly pivots with respect to the bed of the bending brake.

24. A back gage for automatically measuring a sheet metal workpiece when said workpiece is installed in a bending brake, said brake being of a type that comprises a generally rectangular support surface and a shaping edge arranged along one side of the support surface, said brake forming a shaped contour in the sheet metal workpiece by retaining a first portion of said workpiece in engagement with the support surface while a second portion of said workpiece is folded around the shaping edge, the sheet metal workpiece having a leading edge which is inserted into the bending brake, the back gage automatically measuring the distance between the leading edge of the sheet metal workpiece and the shaping edge of the bending brake when said workpiece is installed in the bending brake, the back gage comprising, in combination:

a carriage assembly arranged to be mounted generally parallel to the shaping edge of the bending brake and movable relative thereto, the carriage assembly disposed to engage the support surface of the bending brake, the carriage assembly providing a movable stop for the leading edge of the sheet metal workpiece when said workpiece is inserted into the bending brake;

a drive assembly for selectively and reversibly moving the carriage assembly relative to the shaping edge of the bending brake; and an extendable and retractable measuring device adapted to be mounted to the bending brake and coupled to the carriage assembly, the extendable and retractable measuring device displaying the distance between the leading edge of the sheet metal workpiece and the shaping edge of the bending brake when the leading edge of said workpiece engages the movable stop.

25. A back gage for use with a bending brake of a type that comprises a generally rectangular support table having four sides and a top surface, a brake edge arranged along one side of the support table, and a pivotable bending element, the bending brake forming a shape in a sheet metal workpiece by retaining a first portion of said workpiece in engagement with the top surface of the support table while a second portion of said workpiece is folded around the brake edge by the bending element, the sheet metal workpiece having a leading edge which is slid along the top surface of the support table in order to insert said workpiece into the bending brake, the back gage automatically measuring the distance between the leading edge of the sheet metal workpiece and the brake edge of the bending brake when said workpiece is fully inserted into the bending brake, the back gage comprising, in combination:

a carriage assembly arranged to be mounted generally parallel to the brake edge of the bending brake and movable relative thereto, the carriage assembly having a plurality of fingers disposed to engage the top surface of the support table;

a drive assembly including a reversible motor for selectively moving the carriage assembly relative to the brake edge of the bending brake; and a tape measure adapted to be mounted to the bed of the bending brake and coupled to the carriage assembly, the tape measure displaying the distance between the leading edge of the sheet metal workpiece and the brake edge of the bending brake when the leading edge of said workpiece engages the fingers of the movable carriage assembly.

* * * * *